US010168103B2

(12) United States Patent
Raunio

(10) Patent No.: US 10,168,103 B2
(45) Date of Patent: Jan. 1, 2019

(54) STRUCTURE FOR THE END OF PRESSURE VESSELS, MOST APPLICABLY PLATE HEAT EXCHANGERS, FOR REDUCING THE EFFECTS OF MOVEMENT CHANGES AND VIBRATIONS CAUSED BY VARIATIONS IN INTERNAL PRESSURE AND TEMPERATURE, A METHOD FOR IMPLEMENTING IT AND USE OF SAME

(71) Applicant: Raucell Oy, Riihimäki (FI)

(72) Inventor: Pentti Raunio, Riihimäki (FI)

(73) Assignee: RAUCELL OY, Riihimäki (FI)

( * ) Notice: Subject to any disclaimer, the term of this patent is extended or adjusted under 35 U.S.C. 154(b) by 0 days.

(21) Appl. No.: 15/594,135

(22) Filed: May 12, 2017

(65) Prior Publication Data

US 2017/0343292 A1 Nov. 30, 2017

(30) Foreign Application Priority Data

May 24, 2016 (FI) ..... 20165431

(51) Int. Cl.

| | |
|---|---|
| ***F28F 9/00*** | (2006.01) |
| ***F28D 9/00*** | (2006.01) |
| ***F28F 3/08*** | (2006.01) |

(52) U.S. Cl.

CPC ..... *F28D 9/0093* (2013.01); *F28D 9/0006* (2013.01); *F28F 3/08* (2013.01); *F28F 9/00* (2013.01); *F28F 9/005* (2013.01); *F28F 2225/02* (2013.01); *F28F 2265/30* (2013.01); *F28F 2280/06* (2013.01)

(58) Field of Classification Search

CPC .... F16F 9/02; F16F 9/04; F16F 9/0436; F16F 9/0472; F28F 2265/30

USPC ..... 165/69; 267/64.11

See application file for complete search history.

(56) References Cited

U.S. PATENT DOCUMENTS

| | | | | |
|---|---|---|---|---|
| 3,815,885 A * | 6/1974 | Moulton | F16F 9/081 267/64.23 |
| 3,834,544 A | 9/1974 | Tyson, Jr. et al. | |
| 4,286,549 A * | 9/1981 | Eisinger | F22B 37/244 122/510 |

(Continued)

FOREIGN PATENT DOCUMENTS

| | | |
|---|---|---|
| DE | 10046691 C1 | 4/2002 |
| EP | 0 375 691 A1 | 7/1990 |

(Continued)

*Primary Examiner* — Allen Flanigan

(74) *Attorney, Agent, or Firm* — Birch, Stewart, Kolasch & Birch, LLP

(57) ABSTRACT

A structure for the end of pressure vessels, most applicably plate heat exchangers, for reducing the effects of movement changes and vibrations caused by variations in internal pressure and temperature. The end is made up of a heat transfer plate and an end part in such a way that the end part is connected by welding to the shell of the outer surface of the heat exchanger stack, forming an enclosed chamber on the end of the heat exchanger, into which chamber higher pressure than the external pressure level is brought and/or generated. The higher pressure receives and dampens, via a heat transfer plate, vibration and pressure shocks harmful to the heat exchanger structure in the medium circuits of the heat exchanger.

13 Claims, 2 Drawing Sheets

(56) References Cited

U.S. PATENT DOCUMENTS

| | | | | |
|---|---|---|---|---|
| 4,596,285 | A * | 6/1986 | Dinulescu | F28F 3/083 165/166 |
| 5,088,552 | A | 2/1992 | Raunio | |
| 6,474,408 | B1 * | 11/2002 | Yeh | F28D 9/0043 165/82 |
| 7,004,237 | B2 * | 2/2006 | Mathur | F28D 9/0006 165/167 |
| 7,377,292 | B2 * | 5/2008 | Mori | F15B 1/103 138/26 |
| 2012/0061053 | A1 * | 3/2012 | Geskes | F02B 29/0462 165/67 |

FOREIGN PATENT DOCUMENTS

| | | | |
|---|---|---|---|
| EP | 1 163 968 | A2 | 12/2001 |
| EP | 1 163 968 | A3 | 1/2004 |
| FR | 1575395 | A | 7/1969 |
| GB | 1575395 | A | 5/1971 |
| JP | 8-29077 | A | 2/1996 |
| WO | 02/18758 | A2 | 3/2002 |

* cited by examiner

STRUCTURE FOR THE END OF PRESSURE VESSELS, MOST APPLICABLY PLATE HEAT EXCHANGERS, FOR REDUCING THE EFFECTS OF MOVEMENT CHANGES AND VIBRATIONS CAUSED BY VARIATIONS IN INTERNAL PRESSURE AND TEMPERATURE, A METHOD FOR IMPLEMENTING IT AND USE OF SAME

The object of the invention is a structure, according to the preamble of claim 1, for the end of pressure vessels, most applicably plate heat exchangers, for reducing the harmful effects of movement changes and vibrations caused by variations in internal pressure and temperature. The invention also relates to a method according to claim 7 and to use according to claim 12.

OBJECT OF THE INVENTION

The invention relates most preferably to pressure vessels of the plate heat exchanger type, but the structure according to this application is also applicable in other heat exchanger types and pressure vessels, in which it is beneficial to use the invention disclosed herein. More particularly, a structure for the end part of pressure vessels, and most applicably plate heat exchangers, for reducing the effects of movement changes and vibrations caused by variations in internal pressure and temperature, said effects often causing structural damage.

PRIOR ART

Specifications U.S. Pat. No. 3,834,544 A, WO 0218758 A2, JP H0829077 A and EP 1163968 A2 describe the general state of the art, but they do not disclose the end structure according to the invention and the technical advantage achievable with it.

One crucial problem, particularly in plate heat exchangers, is the ability of their end structures to receive the internal pressure exerted by the mediums. Placing a plate stack formed of heat transfer plates, generally spaced by rubber gaskets, between robust end plates is known in the art. The stack is compacted by means of tension bars fastened to the end plates.

When disposing a heat exchanger stack inside an integral shell, a compacting structure based as precisely as possible on the space can be used for compacting the plate stack and keeping it in position. Various types of fitting parts, fitting seals and even spring structures can be used as an additional aid.

When stacking thin heat transfer plates supporting each other, of which there are often over one hundred plates, into a uniformly compact and stationary stack, however, it is not possible to avoid movements of their drumhead-like surfaces that are subjected to pressure and temperature.

Attempts have been made to solve this problem by essentially binding the separate heat transfer plates internally to each other with a brazing mesh, which contains a brazing point in each support point between the plates. Thus a reticular structure is produced that is fully rigid, in which case this brazing mesh receives the pressure exerted on the end parts.

A problem in these structures is that the brazing material cannot be the same material as the plate material, which is usually stainless steel. The brazing filler will melt at a lower temperature than the plate material. Copper is generally used as the brazing filler, which is known to be toxic to aquatic organisms.

Furthermore, a serious deficiency is associated with plate heat exchanger types fabricated by brazing in terms of the structural integrity of their pressure vessel. Corrosion of the brazing meshes binding the heat transfer plates, and the deterioration in strength resulting from this, can cause unexpected and unforeseeable breakage, and even an explosion.

The present patent application relates most preferably to pressure vessels of the plate heat exchanger type, but the structure according to this application is also applicable in other heat exchanger types and pressure vessels, in which it is beneficial to use the invention disclosed herein.

Presented above are structures of plate heat exchangers starting from structures with rubber gaskets, which started to be more widely used in the 1970s. The technique of brazing heat transfer plates to each other started to be used in the mid 1980s. Both these heat exchanger structures in many cases replaced the tubular heat exchangers previously in use. The technique of fabricating the whole structure of a plate heat exchanger by welding was adopted in plate heat exchangers from the beginning of the 1990s.

The aim was to develop heat exchanger products with better strength and better corrosion resistance. A small and compact structure had been achieved earlier, when compared to tubular heat exchangers.

Thin rustproof heat transfer plates, often with a thickness of 0.7 mm, started to be connected to each other at their edges by welding in such a way that every second plate interspace forms its own leak-tight chamber together with others belonging to the same plurality and forms its own heat exchanger circuit, via which a medium flow through the heat exchanger can take place. Heat is transferred from alternating plate interspaces. In these structures the plate edges and flow apertures and their welded seams alternate. A sort of heat exchanger cassette is formed, which does not endure internal pressure but instead tries to expand in the manner of a concertina.

A general solution is to place the heat exchanger cassette fabricated in this way inside a pressure resistant container and to support the end part of it against the ends of the container. As described above, this cassette structure is fitted and compacted as tightly as possible, supporting the ends against the support plates.

The applications, pressures and temperatures of heat exchangers vary greatly. Mediums can be different, also in their corrosion properties, both liquids with their phase transitions and also gases. Systems connected to medium flows, with their various pumps and adjustment devices, and open/closed valves, increase the complexity and variety of the operating conditions.

When the above factors causing a change in medium circuits combine, different changes in temperature and pressure easily produced inside heat exchangers. The speed of these changes can vary and affect the durability of the structures of heat exchangers. Pressure shocks and pressure oscillations are generated, which act on all structural parts joined by welding, and particularly on the edge joints of the thin plates of plate heat exchangers, which joints are connected by welding, and on joints at the point of flow apertures. This stress loading causes hardening of the stainless steel and fractures as a consequence of the hardening.

Initiation of this damage is accelerated by chloride ions and/or fluoride ions contained in the flowing medium. Very low concentrations invoke corrosion as temperatures rise.

These low concentrations are generally present in tap water, and corrosion can appear at temperatures below 100° C. in such water.

Particularly in sheet metal welded joints the primary and most structurally harmful is crevice corrosion, with movement and vibration occurring in a joint lowering the attack threshold. Pit corrosion can also occur. Damage caused by these factors occurs frequently. One example of operating conditions particularly prone to damage is the cooling of exhaust steam with water. Hot steam and intermittently hot water come into the heat exchanger quickly and with very rapid variation. Cooling this flow produces very powerful and rapid pressure shocks, which move the heat transfer plates. It is manifest from what is presented above that, also in normal applications and operating conditions, heat exchangers are subjected to variable pressure loads and temperature loads that can cause premature structural damage. The aim of the present invention is to reduce the occurrence of premature damage in pressure vessels, most applicably of which in plate heat exchangers.

BRIEF DESCRIPTION OF THE INVENTION

The solution according to the invention is characterized by what is disclosed in the characterization part of claim 1. The solution according to the invention is also characterized by what is disclosed in independent claims 7 and 12. The solution according to the invention now presented has some significant advantages, particularly when utilizing it in plate heat exchangers. Most preferably of all the invention is suited to heat exchanger types in which the heat transfer plates support each other with a corrugated, pleated or corresponding groove-type structure, but support each other without a rigid binding, such as brazing or welding.

This type of heat exchanger is presented e.g. in specification EP-0375691 (FI79409). The aforementioned heat exchanger is provided with grooved heat transfer plates that are essentially similar to each other and are stacked superimposed one on top of another.

BRIEF DESCRIPTION OF THE FIGURES

In the following, the invention will be described in more detail by the aid of an example of its embodiment with reference to the attached drawings 1-2, wherein.

DETAILED DESCRIPTION OF THE INVENTION

Figure 1:
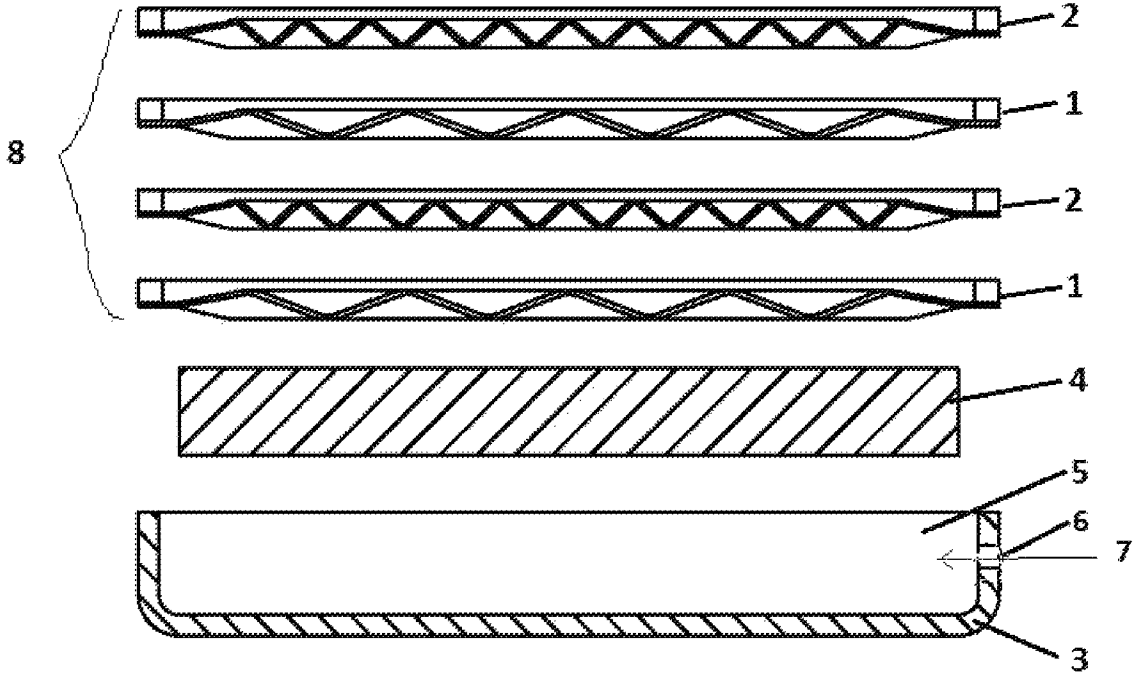
FIG. 1 presents a preferred embodiment of the invention, in which the parts essential to the invention are presented disassembled.

The realization of the present invention is most preferably deployable and applicable in the structure of a heat exchanger, which is disclosed e.g. in patent EP0375691 (FI 79409) and in specification EP-1163968 (US20000253) supplementing said patent. The specification shows more particularly the structure of the ends of a heat exchanger, in which structure the invention is most clearly applicable.

One preferred solution of the invention is presentable by way of illustration as applied to the aforementioned structure. The heat exchanger in specification EP-1163968 (US20000253) is made up of thin, usually stainless steel, 0.4-0.7 mm thick heat transfer plates 1, usually 3 mm thick end parts 3, and narrow joining parts 2 of the thickness of the plate interspace on the edges of the heat transfer plates. The purpose of the joining part 2 is to fit, fasten and seal the heat transfer plates into an integral welded structure on the outer edge. A heat exchanger is formed from the heat transfer plates 1 and the joining parts 2 when piling them one on top of another. It is provided, by welded sealing, with separated chambers formed from alternate plate interspaces, i.e. medium circuits, for heat transfer. A sealed and compact heat exchanger stack 8 is formed, the outer surface of which is welded into an integral shell into which, by means of the joining parts 2, i.e. by opening them applicably, are made inlet and outlet flow apertures into the alternate plate interspaces of the medium circuits.

Figure 2:
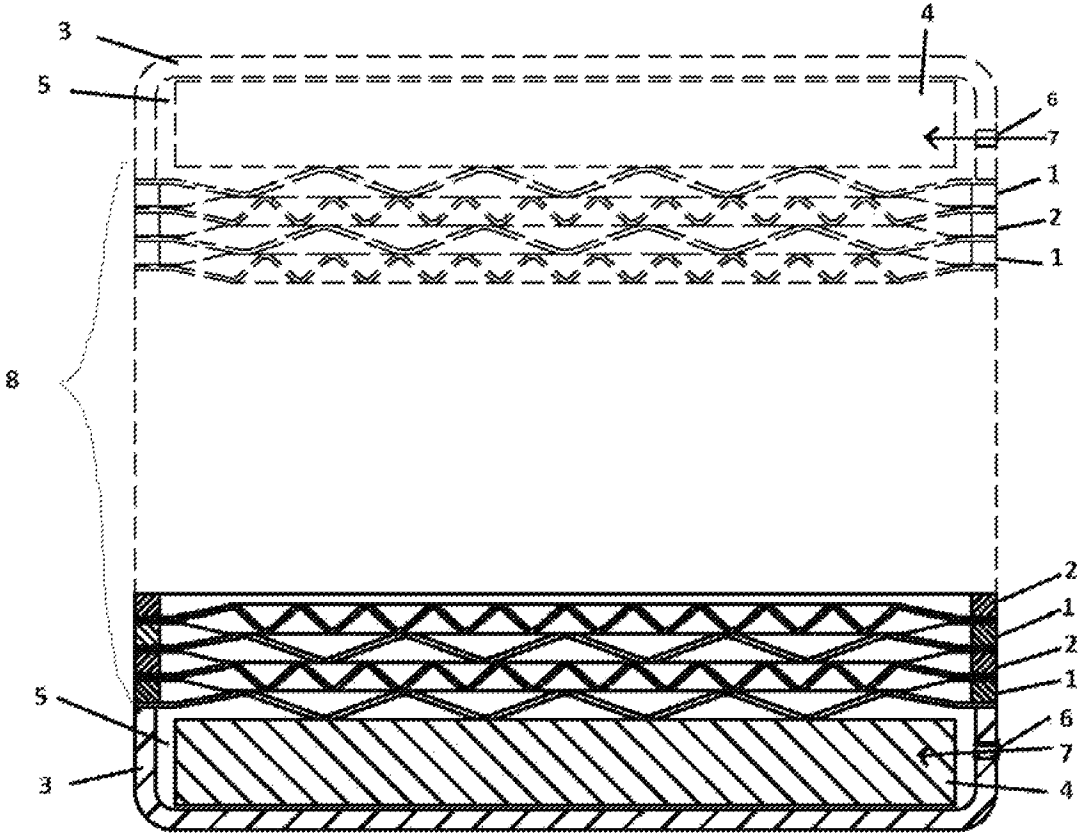
FIG. 2 presents a preferred embodiment of the invention, in which the parts essential to the invention are presented when assembled.

FIGS. 1 and 2 present in a simplified manner the most important parts from the standpoint of the present invention. Most essential is the structure of the ends receiving the internal pressure of the heat exchanger. The ends are built up from parts: a cup-shaped end part 3 and a rigid reinforcing plate 4 fitted as precisely as possible inside the end part 3, although detached from it. The end part 3 is joined by welding to the heat exchanger outer shell described above. In this case the last heat transfer plate of the heat exchanger stack is placed as tightly as possible to rest against the reinforcing plate 4. In this structure the pressure load being exerted on the flexible, drumhead-like, thin heat transfer plates 1 in the end inside the heat exchanger is transmitted via the reinforcing plate 4 and its edges to the end part 3. The load exerted on the end part 3 is almost purely tension and, that being the case, the whole structure has good endurance.

An enclosed chamber 5 is formed on both ends of the heat exchanger from the end structure presented above. Thus one heat exchanger is provided with two, most preferably two, chambers 5, one at each end of the heat exchanger. What is also essential is that the chamber 5 has a definable free volume, reduced by the volume of the reinforcing plate 4, which free volume joins as described above to the rest of the heat exchanger stack 8 bounded by a thin, flexible and drumhead-like heat transfer plate 1.

According to the present invention, higher pressure than the external pressure level is brought into or generated in the chamber 5, the purpose of which higher pressure is to receive and dampen vibration, inside the medium circuit of the heat exchanger for various reasons and harmful to the heat exchanger structure, and pressure shocks.

This structure is useful and possible to implement because the actual operating pressure of the pressure vessel of a heat exchanger is always lower than the test pressure plus safety factors and the corresponding maximum operating pressure permitted by pressure vessel regulations. Furthermore, it is also very possible to make the heat exchanger structure described above significantly exceed these pressure requirements in terms of its strength.

The enclosed chambers 5 of the end parts of the heat exchanger thus function in such a way that when the operating pressure is e.g. 4 bar, which is very usual in systems utilizing steam, an internal gas pressure of 4-6 bar is brought into or generated in the chambers 5 to receive harmful vibration and pressure shocks. If, for one reason or another, the pressure inside the heat exchanger is higher than the pressure in the chambers 5, the reinforcing plate 4 in the structure according to specification EP-1163968 (US20000253) starts to receive the load caused by the pressure. In this situation the strength of the structure corresponds to the pressure vessel requirement set for it and in most cases exceeds it.

Internal gas pressure suited to the operating situation is brought into the chambers 5 on the ends of the heat exchanger by means of a valve or in some other manner via a closable hole 6. The enclosed chamber 5 functions as a pressure chamber, to the inside of which is brought pressure 7 by means of a valve or in some other manner via a closable hole 6, e.g. in such a way that via the hole 6 internal gas pressure 7 preselected to be appropriate to the operating situation is brought in conjunction with the manufacture of the end structure, and it is closed immediately to be leak-tight.

It is advantageous, according to this invention, to generate inside the chambers 5 an internal gas pressure 7 applicable to the operating situation by effect of the temperature from the mediums and by heat conducted into the chamber 5. This occurs by defining the free volume of the chamber 5. Fluid that is vaporizable from the effect of temperature is brought into and enclosed in the chamber 5, the amount of the fluid being proportional to the free volume of the chamber 5. The pressure of the chamber 5 is defined according to the saturated vapor pressure of the amount of vaporizable liquid when the temperature exceeds the vaporization pressure. When the amount of vaporizable liquid has fully vaporized, the pressure does not rise significantly when the temperature rises and the steam superheats.

Water Embodiment

Characteristic to the invention are the enclosed chambers 5, which are connected via thin and flexible heat transfer plates 1 to the rest of the heat exchanger stack.

First, the free volume of the chamber 5 is determined, which is e.g. 1 dl. The mediums and the steam heat the chamber 5 to a temperature of 143° C. The density of the saturated water vapor at a temperature of 143° C. and a pressure of 4 bar is 2.16 kg/m3. If a pressure corresponding to an operating pressure of 4 bar is desired in the enclosed chamber 5, which has a volume of 1 dl, 0.216 ml of water must be brought into it. Thus the magnitude of the pressure in the chamber 5 can be specified by means of the amount of water brought into it.

What is essential to the invention is that the pressure does not rise much above this, even if the temperature of the chamber 5 were to rise significantly. A temperature of e.g. 200° C. is selected. It is seen that when the water vapor becomes superheated, the pressure is 4.6 bar. The pressure level of the chamber 5 has thus not risen much at all. If a temperature of 200° C. and an adequate amount of water required for saturated steam were brought into the chamber 5, the pressure would be 15.5 bar.

From the above, it can be seen that with the preconditions according to the embodiment a sufficiently controllable internal pressure can be generated in the chamber 5 for dampening the pressure shocks and vibration of a heat exchanger that are caused by pressure.

Ammonia-Water Embodiment

Very often the temperature of heat exchanger mediums is below 100° C., in which case according to the embodiment presented above there is no advantage in bringing water into the chamber 5.

A very good and practicable vaporizable liquid at a temperature below 100° C. is ammonia-water. For example, when 25% ammonia-water vaporizes at a temperature of approx. 50° C., a pressure of 3-4 bar is produced before it superheats.

Carbon Dioxide or Ammonia Embodiments

The corresponding embodiments for carbon dioxide and for ammonia according to what is presented above.

Carbon Dioxide Embodiment:

Saturated vapor −28.8° C., in which case the pressure is 15 bar.

Superheated amount of vaporizable mass according to the embodiment at a temperature of +50° C., in which case the pressure is 21.7 bar.

If the amount of mass is increased sufficiently, the pressure at a temperature of +50° C. is 73.8 bar.

Ammonia Embodiment:

Saturated vapor 38.8° C., in which case the pressure is 15 bar.

Superheated amount of vaporizable mass according to the embodiment at a temperature of +110° C., in which case the pressure is 19.9 bar.

If the amount of mass is increased sufficiently, the pressure at a temperature of +110° C. is 75.7 bar.

Air Embodiment

One example of gases worth mentioning is air, which is pressurized in the enclosed space 5 to a pressure of 5 bar when the temperature is 25° C. When the temperature rises to 300° C., the pressure of the gas has risen to only 9.7 bar.

Presented above by way of illustration are some vaporizable liquids and gases suited to an application of the invention.

Essential to the invention is the use of the enclosed chamber 5 formed on the end of a heat exchanger. Accordingly to what is presented above, the chamber 5 is used in the method according to the invention in such a way that a higher pressure 7 than the external pressure level, is brought into and/or generated in the enclosed chamber 5 formed on the end of the heat exchanger, which higher pressure receives and dampens, via a heat transfer plate 1, vibration and pressure shocks harmful to the heat exchanger structure in the medium circuits of the heat exchanger. Particularly essential to the invention is the design of the end, such that the end is constructed from a heat transfer plate 1 and an end part 3, in such a way that the end part 3 is connected by welding to the shell of the outer surface of the heat exchanger stack 8, forming an enclosed chamber 5 on the end of the heat exchanger. In addition to this, into the enclosed chamber 5, inside the end part 3, is fitted a rigid reinforcing plate 4 receiving internal pressure, the reinforcing plate although detached from the end part 3 filling the chamber 5 as well as possible.

It is obvious to the person skilled in the art that the different embodiments of the invention are not limited solely to the examples described above, but that they may be varied within the scope of the claims presented below.

The invention claimed is:

1. A heat exchanger provided with a damping device at one end for reducing effects of movement changes and vibration caused by variations in internal pressure and temperature, the heat exchanger comprising a heat exchanger stack including a plurality of sheet metal heat transfer plates, wherein the damping device is made up of one sheet metal heat transfer plate of the heat exchanger stack and an end part in such a way that the one sheet metal heat transfer plate is hermetically sealed to the end part to form a hermetically sealed chamber on said one end of the heat exchanger, and the hermetically sealed chamber is welded to a shell of an outer surface of the heat exchanger stack and wherein a higher pressure than an external pressure level is brought and/or generated into the hermetically sealed chamber, and the higher pressure receives and dampens, via a heat transfer plate, vibration and pressure shocks harmful to a heat exchanger structure inside medium circuits of the heat exchanger.

2. The heat exchanger according to claim 1, further comprising a reinforcing plate, detached from the end part and filling inside the hermetically sealed chamber as well as possible, in such a way that the one sheet metal heat transfer plate of the heat exchanger stack rests as tightly as possible against the reinforcing plate, in such a way that a pressure load being exerted on the heat transfer plates is transmitted via edges of the reinforcing plate to the end part as almost purely a tensile stress load.

3. The heat exchanger according to claim 2, wherein the heat exchanger includes two of the hermetically sealed chamber formed on two ends of the heat exchanger respectively, each of the two hermetically sealed chambers is a free volume definable according to a size of the respective end part and heat transfer plate, reduced by a volume of the respective reinforcing plate, in such a way that the free volume is connected to the rest of the heat exchanger stack bounded by a thin, flexible and drumhead-like sheet metal heat transfer plate.

4. The heat exchanger according to claim 1, wherein the hermetically sealed chamber is a pressure chamber, to the inside of which is brought gas pressure by means of a valve or in some other manner via a closable hole, in such a way that via the closable hole internal gas pressure preselected to be appropriate to an operating situation is brought in conjunction with a manufacture of the damping device, and the chamber is closed immediately to be leak-tight.

5. The heat exchanger according to claim 1, wherein the hermetically sealed chamber is a pressure chamber, to the inside of which is brought a medium, selected from a group including water, ammonia-water, ammonia, carbon dioxide, and air, and by means of a rise in a temperature of the medium an internal gas pressure appropriate to an operating situation is generated.

6. The heat exchanger according to claim 5, wherein the pressure of the hermetically sealed chamber is defined according to the volume of the chamber and a saturated vapor pressure of an amount of vaporizable fluid of the medium selected for the chamber, when the temperature exceeds the vaporization pressure.

7. A method for reducing effects of movement changes and vibrations caused by variations in internal pressure and temperature of pressure vessels for a heat exchanger, the heat exchanger being provided with a damping device at one end, the heat exchanger comprising a heat exchanger stack including a plurality of sheet metal heat transfer plates, wherein the damping device is made up of one sheet metal heat transfer plate of the heat exchanger stack and an end part in such a way that the one sheet metal heat transfer plate is hermetically sealed to the end part to form a hermetically sealed chamber on said one end of the heat exchanger, and the hermetically sealed chamber is welded to a shell of an outer surface of the heat exchanger stack, wherein the method comprises the step of bringing into and/or generating a higher pressure than the external pressure level into the hermetically sealed chamber, the higher pressure receives and dampens, via a heat transfer plate, vibration and pressure shocks harmful to a heat exchanger structure in medium circuits of the heat exchanger.

8. The method according to claim 7, wherein the hermetically sealed chamber is a pressure chamber, to the inside of which is brought gas pressure by means of a valve or in some other manner via a closable hole, in such a way that via the closable hole internal gas pressure preselected to be appropriate to an operating situation is brought in conjunction with a manufacture of the damping device, and the chamber is closed immediately, by welding, to be leak-tight.

9. The method according to claim 7, wherein the heat exchanger includes two of the hermetically sealed chamber formed on two ends of the heat exchanger respectively, and to the inside of each hermetically sealed chamber is brought a medium, selected from a group including water, ammonia-water, ammonia, carbon dioxide, and air, and by means of a rise in a temperature of the medium an internal gas pressure appropriate to an operating situation is generated.

10. The method according to claim 9, wherein the pressure of the hermetically sealed chamber is defined according to the volume of the chamber and a saturated vapor pressure of an amount of vaporizable fluid of the medium selected for the chamber, when the temperature exceeds the vaporization pressure.

11. The heat exchanger according to claim 3, wherein the hermetically sealed chamber is a pressure chamber, to the inside of which is brought gas pressure by means of a valve or in some other manner via a closable hole, in such a way that via the closable hole internal gas pressure preselected to be appropriate to an operating situation is brought in conjunction with a manufacture of the damping device, and the chamber is closed immediately, by welding, to be leak-tight.

12. The heat exchanger according to claim 3, wherein the hermetically sealed chamber is a pressure chamber, to the inside of which is brought a medium, selected from a group including water, ammonia-water, ammonia, carbon dioxide, and air, and by means of a rise in a temperature of the medium an internal gas pressure appropriate to an operating situation is generated.

13. The method according to claim 8, wherein the heat exchanger includes two of the hermetically sealed chamber formed on two ends of the heat exchanger respectively, and to the inside of each hermetically sealed chamber is brought a medium, selected from a group including water, ammonia-water, ammonia, carbon dioxide, and air, and by means of a rise in a temperature of the medium an internal gas pressure appropriate to an operating situation is generated.

* * * * *